United States Patent [19]

Guity-Mehr

[11] Patent Number: 4,822,085

[45] Date of Patent: Apr. 18, 1989

[54] ADJUSTABLE MAGNETIC DOOR LATCH SYSTEM

[75] Inventor: Hossein F. Guity-Mehr, Long Beach, Calif.

[73] Assignee: Texim International, Irvine, Calif.

[21] Appl. No.: 944,175

[22] Filed: Dec. 22, 1986

[51] Int. Cl.[4] ..... E05C 17/56; E05C 19/16

[52] U.S. Cl. ..... 292/251.5; 335/295

[58] Field of Search ..... 292/251.5; 335/295, 335/287, 288, 298, 306

[56] References Cited

U.S. PATENT DOCUMENTS

| | | | |
|---|---|---|---|
| 1,230,740 | 6/1917 | McCracken | 292/251.5 |
| 2,219,186 | 10/1940 | Hornfeck | 292/251.5 |
| 2,243,616 | 5/1941 | Bing et al. | 335/295 |
| 2,797,655 | 7/1957 | Morehouse | 292/251.5 |
| 2,955,239 | 10/1960 | Rouse | 292/251.5 |
| 3,079,535 | 2/1963 | Schultz | 292/251.5 |
| 3,184,654 | 5/1965 | Bey | 335/295 |
| 3,223,898 | 12/1965 | Bey | 335/295 |
| 3,288,511 | 11/1966 | Tavano | 292/251.5 |
| 3,314,707 | 4/1967 | Van Donselaar | 292/251.5 |
| 3,326,588 | 6/1967 | Clark | 292/251.5 |
| 3,452,310 | 6/1969 | Israelson | 335/295 |
| 3,539,214 | 11/1970 | Fisher | 292/251.5 |
| 4,055,824 | 10/1977 | Baermann | 335/295 |
| 4,099,755 | 7/1978 | Anderson | 292/251.5 |

FOREIGN PATENT DOCUMENTS

| | | | |
|---|---|---|---|
| 183670 | 11/1955 | Austria | 292/251.5 |
| 855494 | 7/1949 | Fed. Rep. of Germany | 335/295 |
| 1081162 | 5/1960 | Fed. Rep. of Germany | 292/251.5 |
| 1118574 | 11/1961 | Fed. Rep. of Germany | 335/295 |
| 1179194 | 5/1959 | France | 292/251.5 |
| 618313 | 3/1961 | Italy | 292/251.5 |
| 13000 | 1/1979 | Japan | 292/251.5 |
| 102046 | 8/1979 | Japan | 292/251.5 |
| 592953 | 2/1978 | U.S.S.R. | 292/251.5 |

*Primary Examiner*—Gary L. Smith
*Assistant Examiner*—Eric K. Nicholson

[57] ABSTRACT

A rotatably adjustable two magnet door latch system is presented. Ferro magnetic latching means are normally coupled to the edge of a door stop. A multi-part door latch assembly is coupled to the edge of the door adjacent the stop when the door is closed.

The assembly comprises a first thin magnet having a straight edge and an opposite concave edge. A second generally planar thin magnet has a first convex edge of radius equal to and fitting into the concave edge of the first magnet. Rotating means rotate the second magnet. Magnetic flux is a function of the length of arcs of the magnets that are adjacent. One or more flux plates transmit flux from the magnets to the stop and a housing modularizes the assembly for easy installation and protection against dirt.

4 Claims, 5 Drawing Sheets

ADJUSTABLE MAGNETIC DOOR LATCH SYSTEM

BACKGROUND OF THE INVENTION

1. Field of the Invention

The present invention relates to means to keep doors closed.

2. Description of the Prior Art

Means of keeping doors closed date back to pre-history, probably to the first time a cave man put a rock at the entrance to a cave. The typical door today has a rotating handle which removes and inserts various types of retaining means into a recess in the door jamb. Most typically, interior doors do not lock except perhaps in areas like a bathroom.

Various types of levers and handles have been utilized to perform similar tasks not only on doors between rooms but on a variety of other doors such as automobile doors, refrigerator doors, etc.

Refrigerators have occasionally been abandoned, and they make an interesting place for children, somewhat of an attractive nuisance. As a result, a substantial number of children have found abandoned refrigerators, opened the doors from outside, then enter the refrigerator to hide and close the doors and then suffocated and died. This led to a demand for some other way to lock refrigerator doors which resulted in magnetic coupling means.

Magnetic couplings means are inherently more efficient than the typical prior art door, because all you have to do is close the door and it will stay closed. You do not have any mechanical moving parts, and you do not have to rotate the handle or make sure that a latch catches. Magnetic coupling means would make a door easy to open and close from either side.

Unfortunately, prior art magnetic retaining means for doors are not much utilized in internal doors in houses and alike for a substantial number of reasons. One of the major reasons is the fact that magnetic latching means as taught by the prior art are not easily adjustable. The prior art door with a rotating handle requires a certain amount of skill to open and close the door. A small child of the age of one who can walk for example, does not normally have the skill to open a door so that the internal door can be considered child safe and the child can be relied on not to be able to open the door. In contrast, if all one has to do is push against a door, such a child could open the door or, in the alternative, the door would have to be pushed on very hard by an adult for opening.

What is needed but not disclosed by the prior art, is some simple adjustable magnetic latching means that would in effect retain most of the advantages of the prior art doors while adding the advantages inherent to magnetic latching means. Applicants have searched for such adjustable magnetic latching means in the prior art but have not found it. Such an adjustable latch would be particularly useful in areas such as hospitals offices, residences and restaurants where it is necessary to go through doors while carrying something, because the door could be pushed open at appropriate selected times. It would also be a substantial convenience in that the door handle need not be rotated. There would be vast improvements in durability because of the vast reduction in moving parts. With a strong magnet, it could be used as a lock.

SUMMARY OF THE INVENTION

A rotatably adjustable multi-magnet door latch system is presented. The assembly may include more than two magnets, but the preferred embodiment has two magnets.

Ferro magnetic latching means are coupled to one but not both of the following: the edge of a door stop and the edge of the door which when closed is adjacent the edge of the door stop.

The preferred embodiment comprises a six major part door latch assembly coupled to the one of the edge of the door stop and the edge of the door to which the ferro magnetic latching means are not coupled, comprising: two magnets, a housing, two plates, and rotating means.

A first generally planar thin magnet has a first straight edge, relatively short edges adjacent the straight edge and a concave edge adjacent the short edges and aligned along a line generally planar to the straight edge, a first surface defined by the edges having north magnetic polarity and a second surface defined by the edges having south magnetic polarity. The first magnet and the other five parts are bilaterally symmetric, and the latch assembly is bilaterally symmetric when aligned symmetrically only.

A second generally planar thin magnet has a first edge in the shape of a convex arc of radius approximately equal to the radius of the concave arc of the first magnet, the two magnets being coupled by a coupling means so that the convex arc edge of the second magnet can rotate adjacent the concave edge of the first magnet, the arcs of the two magnets being of small enough angles that the second magnet can be rotated entirely out of the arc edge of the first magnet. Two ferro magnetic flux plates are coupled to the magnets so that the ferro magnetic flux plate can couple the door magnetically to the ferro magnetic latching means when the door is closed.

Rotatable coupling means is coupled to the center of the arc of the second magnet to rotate the second magnet in relative to the arc of the first magnet.

Non-magnetic housing means couple together the parts of the multi-part multi-magnet door latch assembly.

A first example comprises a seven part system, the first part comprising ferro magnetic latching means, and the other six parts comprising adjustable magnet door latch assembly as stated previously. The first magnet referred to as a concave magnet, is bilaterally symmetric in two dimensions, parallel to two planar parallel surfaces along a plane disposed therebetween and also about a plane perpendicular to the two surfaces and the first edge also referred to as the base edge.

The second magnet is also bilaterally symmetric in two dimensions and is referred to as a convex magnet and comprises a first convex edge of arc equal to or very slightly less than the concave arc of the concave magnet in which it rotates during operation, the second and third edges comprising partial chords intersecting each other along a plane bilaterally symmetrically dividing the convex magnet along a line through the center about which a circular hole through the concave magnet is defined and around which the concave edge is centered, the partial chords intersecting the concave arc at their opposite ends. The center hole having the shape of a circle and in a first example, the hole further including a truncated pyramid bilaterally symmetrically disposed along the plane bilaterally symmetrically dividing the concave magnet so that the hole about the center has a keyhole shape and mates with rotating adjustment means which has a male cross-section mating with a female cross-section of the keyhole so that rotating the rotating adjustment means rotates the convex magnet.

Two flux plates, one of north magnetic polarity and one of south magnetic polarity are adjacent to and obtain their flux from the opposite surfaces of the concave and convex magnets.

The first generally planar thin ferro magnetic flux plate has a first edge having the shape of a straight line or plane, except that it is very thin and accordingly called a line which can couple magnetically to the ferro magnetic latching means, the interior surface of the generally planar thin ferro magnetic cover flux plate defining a hole to which adjustment means may be coupled, and at least one other edge of the flux plate having a first selected polarity which is determined by the orientation of the magnets.

The second generally planar thin ferro magnetic flux plate has a L-shaped cross-section and opposite polarity to the first generally planar thin ferro magnetic cover flux plate which polarity is determined by the orientation of the magnets, one flux plate being adjacent the north magnetic magnet surfaces and the other flux plate being adjacent the south magnetic magnet surfaces and each flux plate having its flux imposed by the adjacent magnet surfaces. If the orientation of the magnet surfaces is reversed by reversing the magnets, the polarity of the flux plates will also be reversed to coincide with the new orientation of the magnets. In the preferred embodiment, the convex magnet rotates in and out of the concave arc formed by the concave magnet. It is obvious that magnetic strength is strongest when the convex magnet is totally within the concave magnet and that magnet strength reduces as a function of rotation of the convex magnet out of the concave magnet. The equivalent could be done in numerous other ways, such as by slightly changing the plane of the convex magnet so that the magnetic north surfaces and south surfaces of the two magnets are not coplanar. Alternatively, the two magnets could be rectangular, and the moving magnet could slide away from the stationary magnet which is the concave magnet in the present example to reduce magnetic strength. Other examples will be obvious to those skilled in the prior art but will be the equivalent of the embodiment described in detail herein.

DRAWING DESCRIPTION

Reference should be made at this time to the following detailed description which should be read in conjunction with the following drawings, of which:

DETAILED DESCRIPTION

Figure 1:
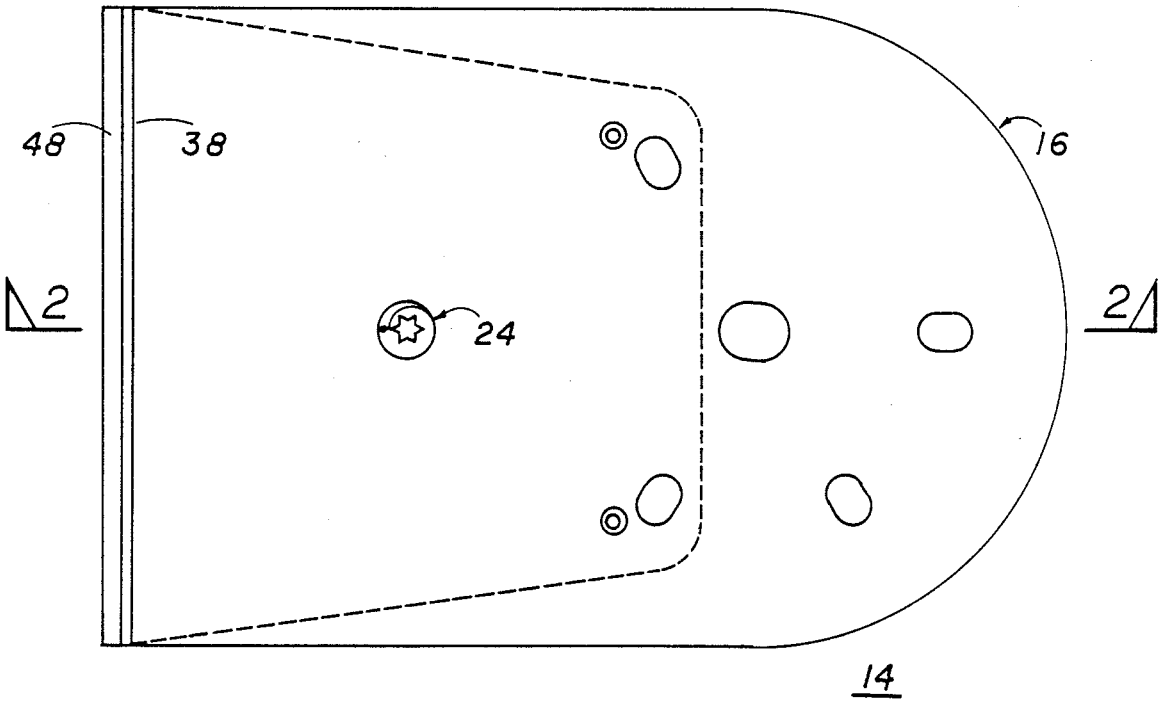
FIG. 1 is a plan view of a multi-part multi-magnet door latch assembly according to the present invention.
Figure 2:
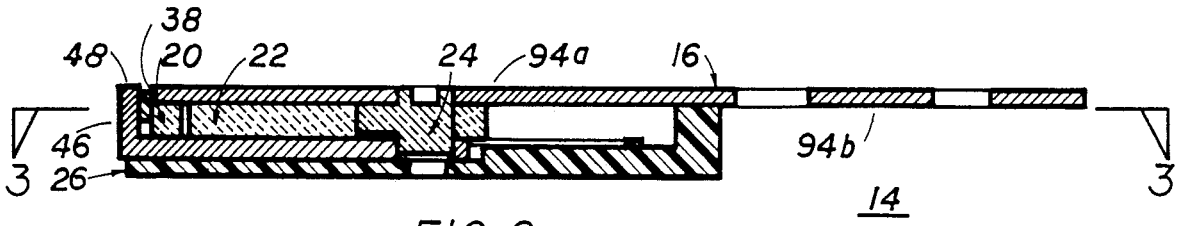
FIG. 2 is a section of the door latch assembly of FIG. 1 along the line 2—2.
Figure 3:
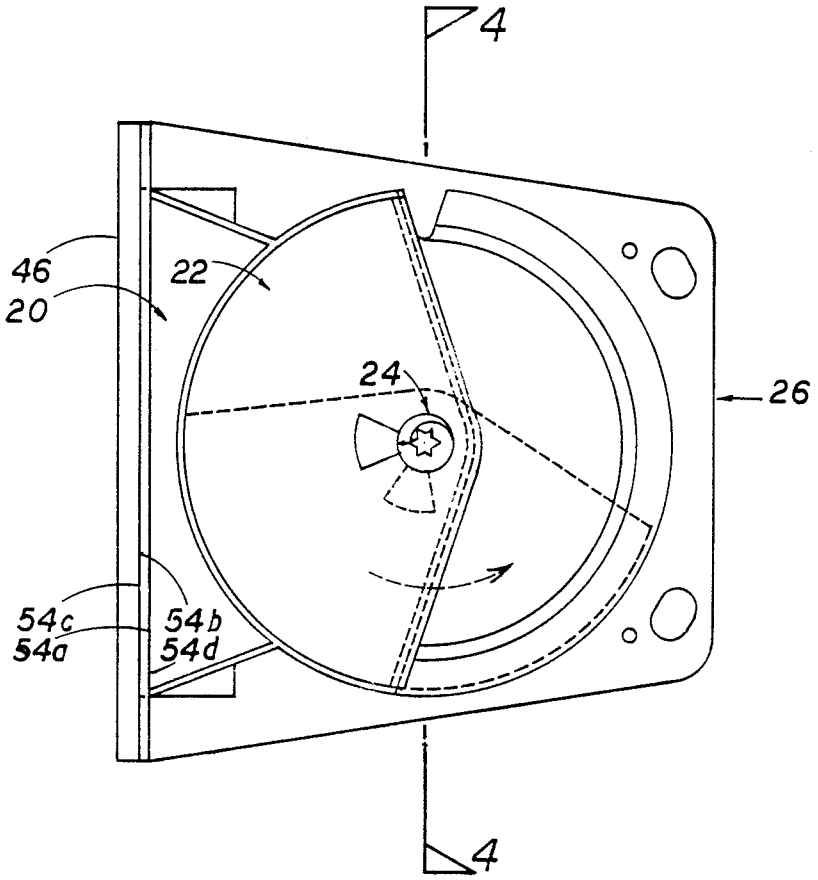
FIG. 3 is a section of the multi-part multi-magnet door latch assembly of FIG. 2 along the line 3—3.
Figure 4:
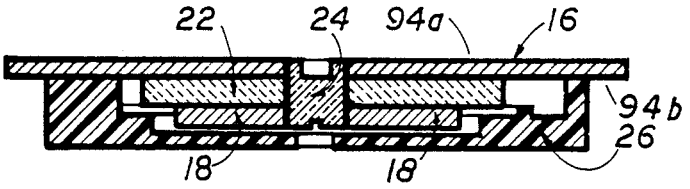
FIG. 4 is a section of the door latch assembly of FIG. 3 along the line 4—4.
Figures 5, 6:
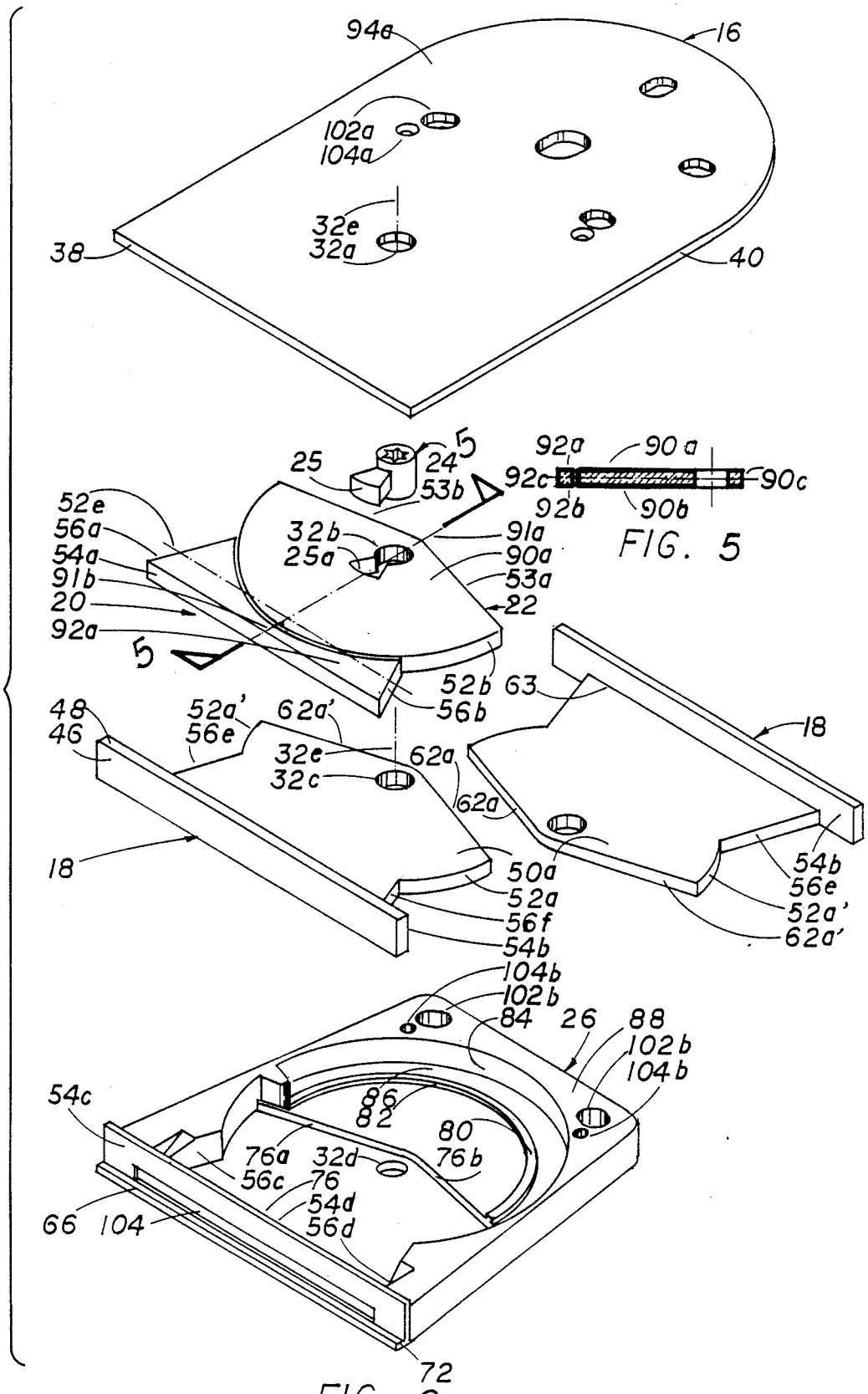
FIG. 5 is a section of the magnets along the line 5—5 in FIG. 6.
FIG. 6 illustrates a three quarter view of the six parts of the door latch assembly of FIG. 1 with each part shown separately.
Figure 7:
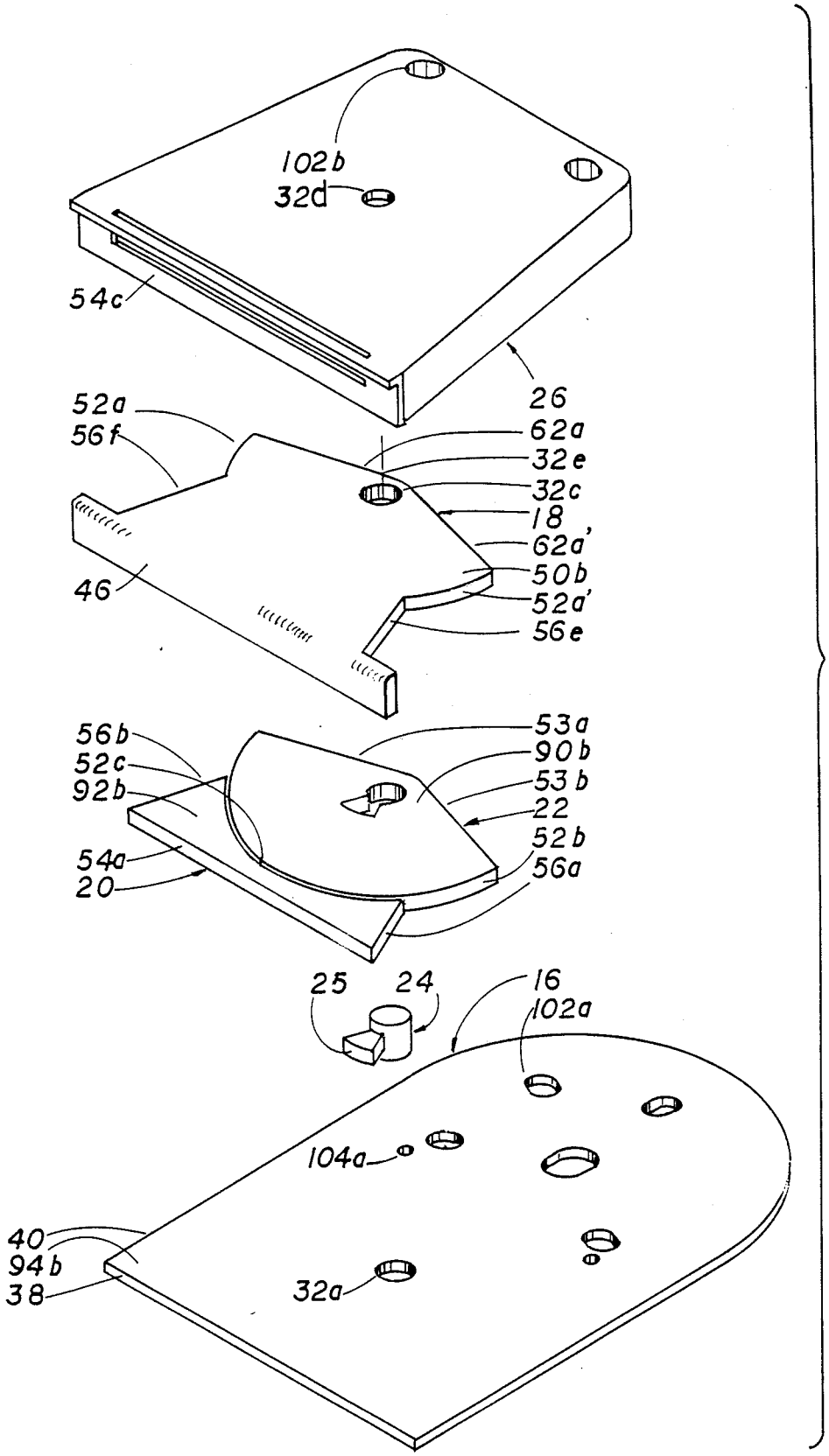
FIG. 7 illustrates a three quarter view of the opposite side of the six elements illustrated in FIG. 6.

Reference should be made at this time to FIGS. 1–9 which illustrate various examples of a rotatably adjustable multi-magnet door latch assembly 10 also referred to as latch system 10 capable of latching a door 28 closed. The latch system 10 comprises two major parts, a ferro magnetic latching means 12 also referred to as latching means 12 and a multi-part multi-magnet door latch assembly 14 also referred to as a magnet assembly 14.

Figure 8:
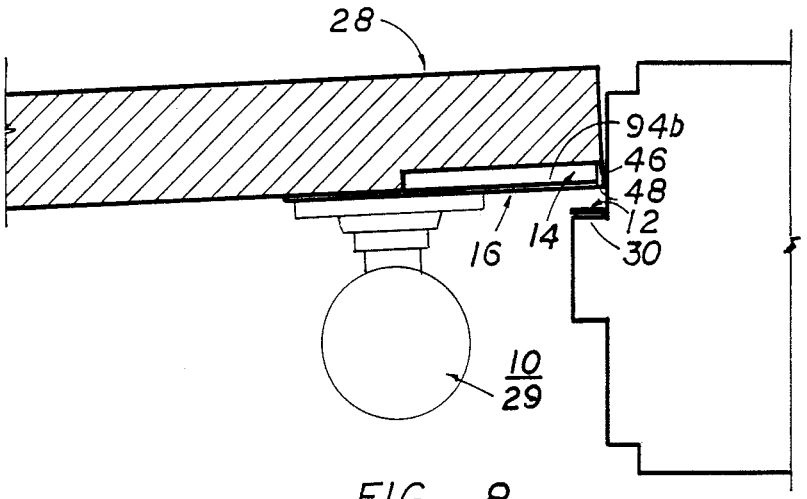
FIG. 8 illustrates a partially cut away top view of a rotatably adjustable multi-magnet door latch system capable of latching a door closed assembled on a door with the door substantially closed.
Figure 9:
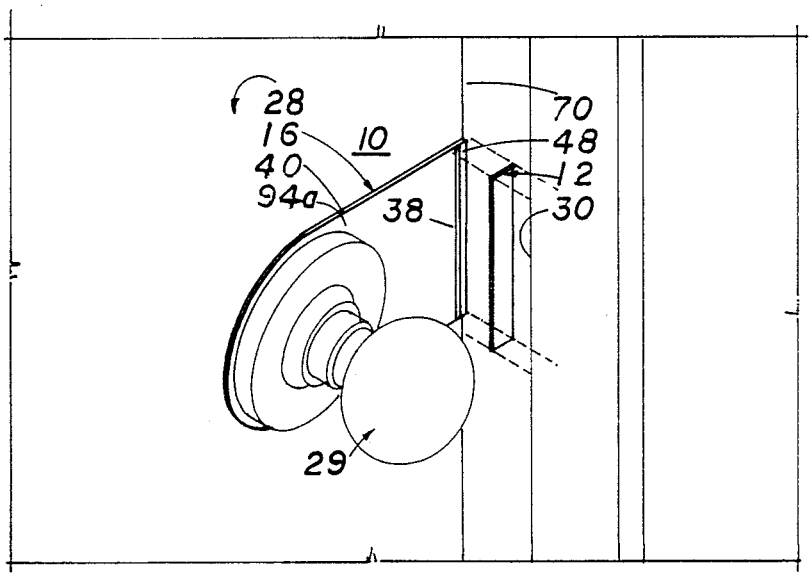
FIG. 9 illustrates a three quarter view of the door latch system of FIG. 8.

The latching means 12 can be fabricated from any materials having ferro magnetic capabilities so that a magnet could latch to the latching means 12. The latching means 12 is coupled to one but not both of the following: the edge of a door stop 30 as shown in FIGS. 8 and 9 and the edge 70 of the door 28 which when closed is adjacent the edge of the door stop 30. While the magnet assembly 14 is relatively rugged, it might be possible to injure the magnet assembly 14 by exerting sufficient force to it, but such force would probably also destroy the door 28 and door stop 30, so it does not really matter whether the magnet assembly 14 is on the door 28 and the latching means 12 is on the door stop 30, or just the contrary, the magnet assembly 14 is on the door stop 30 and the latching means 12 is on the door 28. The door stop 30 may also be referred to as a door jamb 30. The latching means 12 comprises only one part and can be coupled to the door 28 or door stop 30 by any means known to the prior art such as glue, screws, etc.

The magnet assembly 14 which mates with the latching means 12 when the door 28 is closed against the door stop 30 comprises six parts plus coupling means of a type used in the prior art. The magnet assembly 14 latches with the latching means 12 with a force of for most household purposes 20 pounds or less as selected by the user. The latching force is analog adjustable by rotating rotating adjustment means 24 also referred to as adjustment means 24. Other major elements of magnet assembly 14 comprise a flux plate 16 which is generally planar and is also referred to as a magnetic flux plate 16, an L-shaped cross-section magnet flux plate 18 also referred to as an L-plate 18, two generally planar thin magnets 20, 22 and non-magnetic housing 26.

The first generally planar thin magnet 20 also referred to as the concave magnet 20 has a first straight edge **54*a*, relatively short edges 56*a*, 56*b* adjacent the straight edge 54*a* and a concave edge 52*c* from which the concave magnet 20 receives its name. The concave edge 52*c* is adjacent the short edges 56*a*, 56*b* and aligned along a line 52*e* generally parallel to the straight edge 54*a*. The two sides 92*a*, 92*b* defined by the edges 54*a*, 56*a*, 56*b*, 52c comprise surfaces 92*a*, 92*b*, one of which is a north magnetic pole and the opposite of which is a south magnetic pole. It should be noted that the magnets 20, 22, are unusual. One normally expects the north and south magnet poles of a magnet to be relatively far apart, usually at opposite ends. While the north and south poles of magnets 20, 22 are at opposite ends, they are planar, widely distributed and very close together, separated by a distance only a tiny fraction of the length of the magnets 20, 22. It does not matter which surface is north pole and which surface is south pole, so long as the magnets 20, 22 are aligned in the magnet assembly 14** with the north poles coplanar and the south poles coplanar or substantially coplanar.

The second generally planar thin magnet 22 also referred to as convex magnet 22 has a first edge **52*b* in the shape of a convex arc 52*b* of radius approximately equal to but in a preferred example slightly less than the radius of the concave arc 52*c* of the concave magnet 20. The concave and convex arcs 52*c*, 52*b* are also referred to as edges 52*c*, 52*b*. The magnet 22 is coupled by coupling means 24 also referred to as rotating adjustment means 24 to L-plate 18 and flux plate 16 so that the convex arc 52*b* of the convex magnet 22 can be rotated by notches 25, 25*a* adjacent the concave edge 52*c* of the concave magnet 20, the arcs 52*c*, 52*b* of the two magnets 20, 22 being of small enough angles substantially less than 180° that the convex magnet 22 can be rotated entirely out of the arc edge 52*c* of the concave magnet 20**.

At least one ferro magnetic flux plate must be coupled to the magnets 20, 22 so that the ferro magnetic flux plate can couple the door magnetically to the latching means 12 when the door 28 is closed. In the example illustrated, two flux plates 16, 18 are utilized for greater efficiency.

Non-magnetic housing means 26 also referred to as housing 26 couple together the parts of the multi-part multi-magnet door latch asesmbly 14. Rotatable coupling means 24 are coupled to the center of the arc **52*b* of the convex magnet 22 to rotate the convex magnet 22 in relation to the arc 52*c* of the concave magnet 20 via notch 25 of rotatable coupling means 24 and magnet notch 25*a*. The convex arc 52bof the convex magnet 22 and the concave arc 52*c* of the concave magnet 20** are at all times concentric.

The generally planar thin ferro magnetic cover flux plate 16 or flux plate 16 has a first edge 38 having the shape of a nearly linear plane segment which can couple magnetically to the ferro magnetic latching means 12. The interior surface **32*a* of the generally planar thin ferro magnetic cover flux plate 16 defines a hole 32*a* to which adjustment means 24 are coupled. At least one other edge of the flux plate 16 has a first selected polarity which is determined by the orientation of the magnets 20, 22. It does not matter whether the edge 38 is north magnetic or south magnetic, so long as the magnets 20, 22** are oriented with their north polarity surfaces parallel and their south polarity surfaces parallel.

The second generally planar thin L-shaped cross-section ferro magnetic flux plate 18 must have opposite polarity to the first generally planar thin ferro magnetic cover flux plate 16 which polarity is determined by the orientation of the magnets 20, 22. The L-plate 18 comprises a vertical generally thin rectangular facing end 46 which has an interior facing surface **54*b* which is adjacent a facing edge 54*c* of the housing 26. The opposite facing surface 54*d* of the housing 26 is adjacent straight edge 54*a* of concave magnet 20 and edge 38 of flux plate 16. The rectangular facing end 46 has an even thinner generally rectangular facing edge 48 at a 90° angle to the rectangular facing surface 54b and adjacent thereto which edge 48 couples magnetically to the ferro magnetic latching means 12. The L-plate has a second irregular generally planar surface 50*a* coupled to and generally perpendicular to the vertical generally thin rectangular facing surface 54*b*, the second surface 50*a* being generally planar and substantially larger in width than the vertical generally thin rectangular surface 54*b* the irregular surface 50*a* being defined by two concentric arcs 52*a*, 52*a*', two chords, 62*a*, 62*a*', one adjacent each arc 52*a*, 52*a*', and a generally vertical base 63 between two generally vertically sides 56*e*, 56*f*, one adjacent each arc 52*a*, 52*a*', each chord, 62*a*, 62*a*' being adjacent one arc 52*a*, 52*a*' and the other chord 62*a*', 62*a*. In the preferred example, the sides 56*e*, 56*f* are at an angle of about 80° to the surface 54*b* and are generally parallel to and adjacent to sides 56*a*, 56*b* of concave magnet 20. Base 63 is generally adjacent and parallel to concave magnet edge 54*a*. Arcs 52*a*, 52*a*' are of the same radius and concentric to convex magnet 22 convex arc 52*c* and are located to be substantially extensions of concave arc 52*c* so that 52*a*, 52*a*' begin where 52*c* ends although 52*a*, 52*a*' are convex while 52*c*** is concave.

The interior surface **50*a* of the second generally planar thin L-shaped cross-section ferro magnetic angle flux plate 18 defines a circular hole 32*c* concentric with the center defined by the two arcs 52*a*, 52*a*' and concentric to and of radius substantially equal to the radius of the hole 32*a* through the first generally planar thin ferro magnetic cover flux plate 16, the holes 32*c*, 32*a*, and 32*b* all having the same radius and being generally circular in cross-section so that rotating adjustment means 24 rotates in each of said three holes, 32*a, b, c*, adjacent the surfaces 32*a, b, c*, defining said holes 32*a, b, c*, permitting male notch 25 to rotate convex magnet 22 via female notch 25*a***.

The first thin generally planar magnet 22 or concave magnet 22 is bilaterially symmetric in two dimensions, parallel to the surfaces **92*a*, 92*b* and disposed equally therebetween and perpendicular to the edge 54*a* midway between the sides or edges 56*a, b*. The magnet 20 has four edges 54*a*, 56*a*, 56*b* and 52*c* and two generally planar surfaces 92*a*, 92*b* defined by the four edges 54*a*, 56*a*, 56*b*, 52*c*. The first base edge 54*a* defines a straight line. The second concave edge 52*c* is generally aligned along the line 52*e* parallel to the first edge 54*a* but the second edge 52*c* has the shape of a concave arc of radius about equal to the radii of the two arcs 52*a*', 52*a* of the irregular surfaces 50*a*, 50*b* of the planar thin L-shaped cross-section ferro magnetic angle flux plate 18. The other two edges 56*e*, 56*f*, the third and fourth edges of concave magnet 20 are each coupled between the straight first edge 54*a* and the concave edge 52*c* and form in a primary example an angle of about 80° with a base edge 54*a*. A first surface 92*a* defined by the four edges, 54*a*, 56*a*, 56*b*, 52*c* has magnetic north polarity and the second surface 92*b* parallel to the first surface 92*a* and disposed of a very small distance therefrom across the thickness of concave magnet 20 has magnetic south polarity. This is an unusual polarity for a magnet since the north and south polarities are spread out over relatively large surfaces 92*a*, 92*b* comprising the vast majority of the total surface of concave magnet 20 and are disposed close together a tiny fraction of the length of concave magnet 20 along edge 54*a***.

A second thin generally planar partially convex magnet 22 is bilaterally symmetric in two dimensions, about a plane **90*c*, parallel to and midway between surfaces 90*a* and 90*b* and co-planar with plane 92*c* midway between surfaces 92*a* and 92*b* about which plane 92*c* magnet 20 is bilaterally symmetric, and additionally magnet 22 is symmetric about plane 91*a* which goes between the intersection of chords 53***a* and 53*b* and the center line 32*e* about which the holes 32*a*–32*d* are concentric. Planes 90*c* and 92*c* are the same plane.

Convex magnet 22 has three edges, arc 52*b* and chords 53*a*, 53*b* and two generally planar surfaces 90*a* and 90*b* parallel to each other and bilateral symmetry plane 90*c*. The first edge 52*b* comprises a convex arc with an arc length greater than the concave arc 52*c* of concave magnet 20. Chords 53*a*, 53*b* are only partial chords, sine they intersect arc 52*b* at one end, then intersect each other and terminate near center line 32*e* so that they are each slightly greater than a radius of the circle defined by arc 52*b* and centered on line 32*e*.

Male notch 25 has the same cross-section as female notch 25a with which it mates to rotate partially convex magnet 22 which is also referred to convex magnet 22. Concave magnet 20 which is actually only partially concave along the arc adjacent convex magnet 22 has an identical cross-section and surface 92*a* or *b* to the adjacent part of thin generally planar L shaped cross-section ferro magnet angle flux plate 18 surface 50*a*, set adjacent cross-section of L plate 18 being at a 90° angle to that cross-section of L plate 18 which has an L shape. That part of L plate surface 50*a* not identical in cross-section to the cross-section of concave magnet 20 surface 92*a* or *b* (depending on orientation) is identical except for notch 25*a* to surface 90 *a* or 90 *b* (depending on magnet orientation) of convex magnet 22.

A particular example having a particular concept, features, design criteria, arrangement and structure is described herein. Changes and modifications of the design and arrangement described herein will be obvious to those skilled in the art. Other applications will also be obvious such as latches for cabinets, closets, desks, cupboards, etc. The magnetic latch can, of course, be utilized with a door knob or in certain applications without a door knob. Different materials, of course, can be used. Changes in aesthetics, features, or decoration of the components would be obvious as would changes of the design as described at the end of the Summary of the Invention utilizing the concept of changing magnetic force by rotary, linear or other motions which create an air gap to reduce magnetic force. Other modifications of the disclosed embodiment within the scope of the disclosed embodiment will be obvious to those skilled in the art. The invention is limited, however, only by the following claims.

I claim:

1. A magnetic assembly, comprising:

a first planar ferro magnetic flux plates having a first and a second relatively flat surfaces parallel to each other and on opposing sides of the flux plate, and a second L-shaped cross section ferro magnetic angled flux plate having relatively large flat first and second surfaces parallel to the first planar ferro magnetic flux plate first surface and a relatively small flat third and fourth surfaces perpendicular to and coupled to said first surface and second surface respectively and coupled together by a small fifth tip surface parallel to the first surface, two permanent magnets having north polar surface on one first large flat planar surface adjacent the first surface of one flux plate and south polar surface on an opposing second large flat planar surface parallel to said first planar magnet surface, and adjacent the first surface of the other flux plate, the magnets sandwiched between the flux plate first surfaces, whereby magnetic force is induced by the combination of the second surface of the first flat flux plate near the fifth tip surface and the fifth tip surface of the L-shaped flux plate, and said two flux plates as claimed herein shift the magnetic pull direction of the magnet assembly by 90 degrees causing the magnet assembly to exert the magnet pull force of the magnet assembly perpendicular to the contact surfaces between the permanent magnet and the two flux plates.

2. The invention of claim 1 where the magnetic assembly is capable of being installed on a hinged door edge surface opposite the door hinges and supported by means of the first planar ferro magnetic flux plate of the magnetic assembly, acting as cantilever, and capable of magnetically latching to a ferro magnetic catch plate installed on the part of a door stop mating with the door edge.

3. a rotatably adjustable multi-magnet system, comprising:

a first planar thin ferro magnetic cover flux plate and a second generally planar thin L-shaped cross-section ferro magnetic angle flux plate having opposite polarity to the first plate, the plates arranged so as to generate a magnetic force perpendicular to the magnetic surfaces contacting the flux plates;

wherein the multi-magnet system comprises a rotatable convex thin magnet coupled to a fixed concave thin magnet coupled between the two flux plates and capable when rotated of changing the volume of an air gap between the convex and concave magnets thereby rotatably adjusting magnetic flux.

4. A seven part adjustable magnetic door latch system capable of latching a door closed, comprising:

ferro magnetic latching means capable of being coupled to one of the following: the edge of a door stop mating with the edge of a door and the associated edge of a door which mates with the door stop when the door is closed which door, door stop and door edge are not claimed; and a six part adjustable magnet door latch assembly comprising the following six parts:

a first planar thin ferro magnetic cover flux plate having a first edge having the shape of a linear planar segment which can couple mechanically to the ferro magnetic latching means, the interior surface of the generally planar thin ferro magnetic cover flux plate defining a hole to which adjustment means are coupled, and at least one other edge of the flux plate having a first selected polarity which is determined by the orientation of the magnets;

a second generally planar thin L-shaped cross-section ferro magnetic angle flux plate having opposite polarity to the first generally planar thin ferro magnetic cover flux plate which polarity is determined by the orientation of the magnets, comprising a vertical generally thin rectangulr facing surface having an even thinner generally rectangular facing edge at a 90° angle to the rectangular facing surface and adjacent thereto, which edge couples magnetically to the ferro magnetic latching means and having an irregular generally planar surface coupled to and generally perpendicular to the vertical generally thin rectangular facing surface, the irregular surface being generally planar and substantially larger in width than the vertical generally thin rectangular facing surface the irregular surface being defined by two concentric arcs, two chords, one adjacent each arc and the other chord, two generally vertical sides, one adjacent each arc, and a generally vertical base between the two vertical sides, the interior surface of the second generally planar thin L-shaped cross-section ferro magnetic angle flux plate defining a circular hole concentric with the center defined by the two arcs and of radius substantially equal to the radius of the hole through the first generally planar thin ferro magnetic cover flux plate.

a first thin generally planar magnet bilaterally symmetric in two dimensions and having four edges and two generally planar parallel surfaces, the first base edge defining a straight line, the second edge being generally aligned along a line parallel to the first edge but the second edge having the shape of a concave arc of radius about equal to the radii of the two arcs of the irregular surface of the planar thin L-shaped cross-section ferro magnetic angle flux plate, and the other two edges each coupled between the straight first edge and the concave edge, and forming an angle of about 80° with the base edge, a first surface defined by the four edges having magnetic north polarity and the second surface parallel to the first surface and disposed a very small distance thereform having magnetic south polarity;

a second thin generally planar magnet bilaterally symmetric in two dimensions and having three edges and two generally planar parallel surfaces, the first edge comprising a convex arc of radius marginally less than the radius of the convex arc of the first magnet.

* * * * *